United States Patent [19]

Naumann

[11] Patent Number: 5,018,414

[45] Date of Patent: May 28, 1991

[54] TRANSMISSION SERVICING TOOL

[76] Inventor: Richard C. Naumann, 2061 Pepperwood Ct., Redwood Valley, Calif. 95470

[21] Appl. No.: 532,799

[22] Filed: Jun. 4, 1990

[51] Int. Cl.[5] ..... B25B 25/00

[52] U.S. Cl. ..... 81/484; 81/488

[58] Field of Search ..... 81/488, 484, 486; 29/240

[56] References Cited

U.S. PATENT DOCUMENTS

| | | | |
|---|---|---|---|
| 2,810,314 | 10/1957 | Strong | 81/486 |
| 3,340,752 | 9/1967 | Carney et al. | 81/484 |
| 4,535,655 | 8/1985 | Avery | 81/484 |
| 4,756,215 | 7/1988 | Darnell | 29/240 |

*Primary Examiner*—Roscoe V. Parker

[57] ABSTRACT

The torque converter repair tool of this disclosure includes a small plate that can be mounted on the torque converter housing with the starter motor removed. A positioning hole in the plate engages over a locator stud, which is normally used to position the starter motor, and another hole slideably receives a hand screw that threads into a tapped hole in the housing to secure the tool temporarily in place. A shaft is rotatable in the plate, and, when in place, a pinion on the inboard portion of the shaft engages the ring gear of the torque converter. The outboard end of the shaft may be engaged by a socket wrench for hand rotation of the shaft and, with it, the flywheel.

7 Claims, 2 Drawing Sheets

TRANSMISSION SERVICING TOOL

BACKGROUND OF THE INVENTION

In removing certain automotive transmission from the engine for servicing, it is necessary to remove the starter motor (after disconnecting the battery to protect against damage from a short) and the cover plate to gain partial access to the interior of the torque converter bell housing for removal of cap screws. Then the starter motor has to be reinstalled and the battery reconnected. The starter motor is then energized briefly, or "bumped", to rotate the torque converter through a small arc to bring at least one of the cap screws, which connect the torque converter to the drive plate, into somewhat more accessible position for removal. With the starter in position, the mechanic must work around it to remove the screw and it is essential that the torque converter drive plate be carefully positioned to provide access for a tool to remove each cap screw. After the first cap screw is removed, the starter is again energized to rotate the torque converter through another small arc to a position to expose the next cap screw or two, to enable the mechanic to loosen those so exposed. This procedure is repeated until all cap screws have been removed. Moreover, the rotation of the ring gear with the starter motor is very difficult to control, and the starter motor is conditioned for rotation in one direction only. Accordingly the torque converter may inadvertently be allowed to overrun the relatively short arc of movement in which a cap screw is accessible below the engine, in which case the starter motor has to be energized again either to rotate the torque converter through almost a complete revolution for another attempt, or to skip it from the moment and go on to the next boss and cap screw. When all cap screws are finally removed, the mechanic again disconnects the battery before removing the starter motor from the transmission housing, and then removes all other fasteners necessary to remove the transmission-converter from the vehicle.

Thus, it is a tedious, time-consuming process just to remove the cap screws that link the torque converter drive plate to the crank shaft to enable servicing of the torque converter, and the mechanic has to go through the reverse process to replace the cap screws after the torque converter has been serviced. Moreover, a mechanic may prefer to just tighten each of the series of cap screws partially and then return to each in sequence to tighten them completely, one at a time, in order to maintain relative uniformity in load. So, it may take two or more of such incremental full turns of the torque converter for complete replacement and tightening of all cap screws.

OBJECTS OF THE INVENTION

It is an object of this invention to provide a tool that will enable rotation of a torque converter and ring gear in closely controlled movements for precise positioning thereof.

It is a further object of this invention to provide a tool that will enable rotation of the torque converter by hand in either direction without use of the starter motor.

It is a further object of this invention to provide a tool that will enable a mechanic to rotate the torque converter ring gear, which is only partially accessible, through a selected arc into an area which is more accessible for removal of cap screws.

It is a further object of this invention to provide a tool to enable one to position a torque converter precisely and to hold it against rotation as a cap screw is being removed.

It is a further object of this invention to provide a tool to replace the starter motor in rotating the torque converter ring gear for removal of cap screws which because of its relatively small size renders the cap screws more accessible.

It is a further object of this invention to provide a tool to replace the starter motor in rotating the torque converter ring gear for removal of cap screws which because of its relatively small size renders the cap screws more accessible.

It is a further object of this invention to provide a tool that will enable one to rotate the engine from above by use of a long extension drive cable or the like.

Other objects and advantages of this invention will become apparent from the description to follow, particularly when read in conjunction with the accompanying drawings.

SUMMARY OF THE INVENTION

In carrying out this invention, I provide a tool having a plate that can be mounted on the torque converter bell housing in place of a starter motor. A shaft is rotatable in the plate and carries a pinion gear that meshes with the ring gear of the torque converter. A square socket or the like on the outboard end of the shaft, enables the mechanic to use a socket wrench to rotate the torque converter in either direction by hand for quick and precise positioning of the cap screws that couple the drive plate to the engine. A bearing carried on the inboard end of the shaft engages in the conventional bearing and alignment support in the transmission housing.

DESCRIPTION OF A PREFERRED EMBODIMENT

Figure 1:
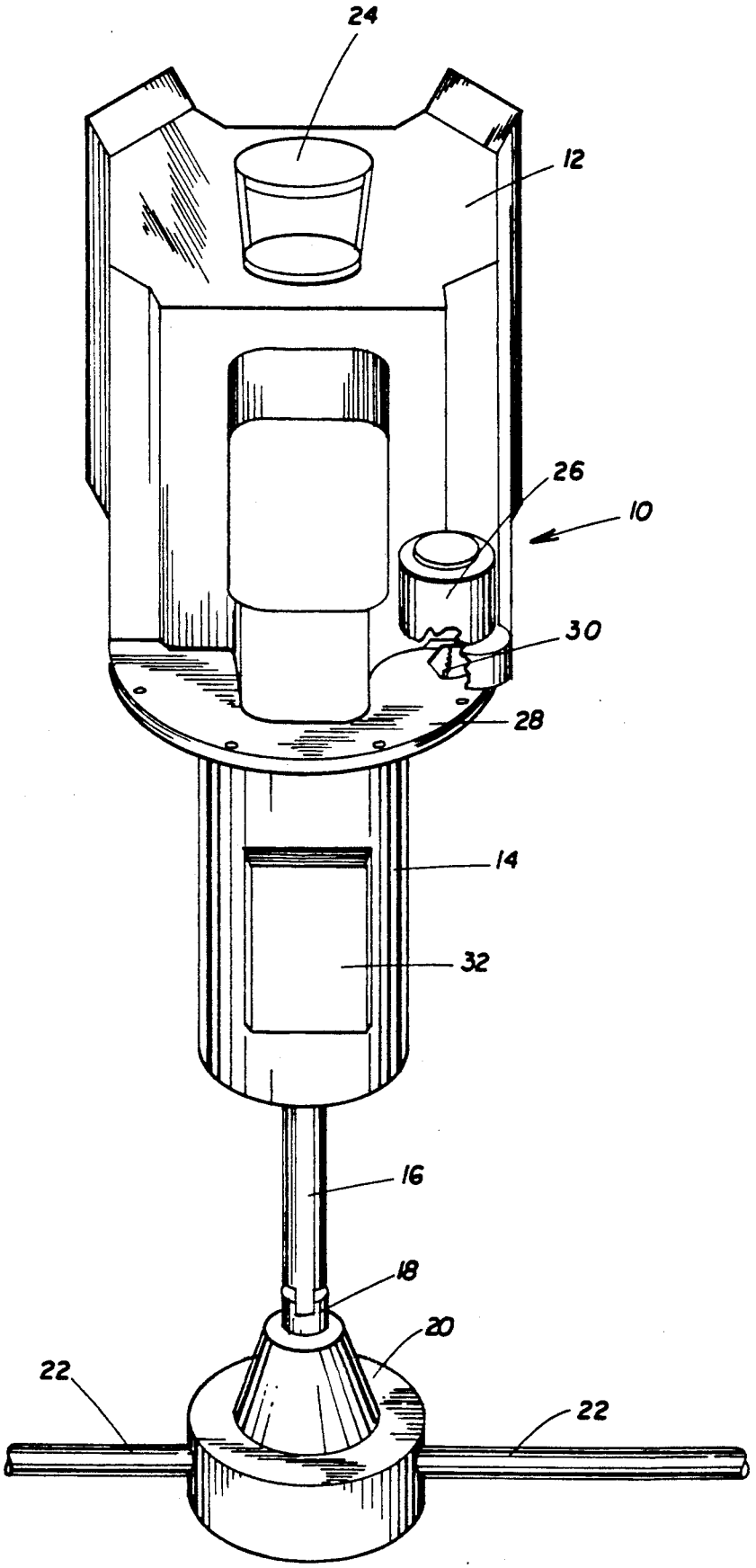
FIG. 1 is a view in perspective, taken from below of the drive train of a motor vehicle.

Referring now to the FIG. 1 with greater particularity, an automotive drive train 10 would include the engine 12, a transmission or torque converter 14, the drive shaft 16 with universal joint 18, and the differential 20 from which are driven the rear axles 22.

Driven from the engine 12 are pulleys 24 for driving auxiliary equipment such as a fan, an alternator and air conditioning. Nested below the engine 12 is the starter motor 26, the shaft of which extends through a cowling or cover plate 28 to engage the ring gear 20 of the torque converter 14. Typically, an oil pan 32 is carried on the bottom of the transmission bell housing 14.

It is apparent that, with the transmission torque converter bell housing 14 mounted on the engine 12, it is necessary to remove the cowling or cover plate 28 in order to gain even partial access to the interior of the torque converter bell housing. Moreover, it is necessary to remove the starter motor 26 prior to removal of the cover plate 28. Then, under present practice it is necessary to replace the starter motor 26 to turn the ring gear 30 through a series of arcs in order to position the drive plate 34 so that a each one of a series of cap screws is exposed through the opening below the engine 12.

Figure 2:
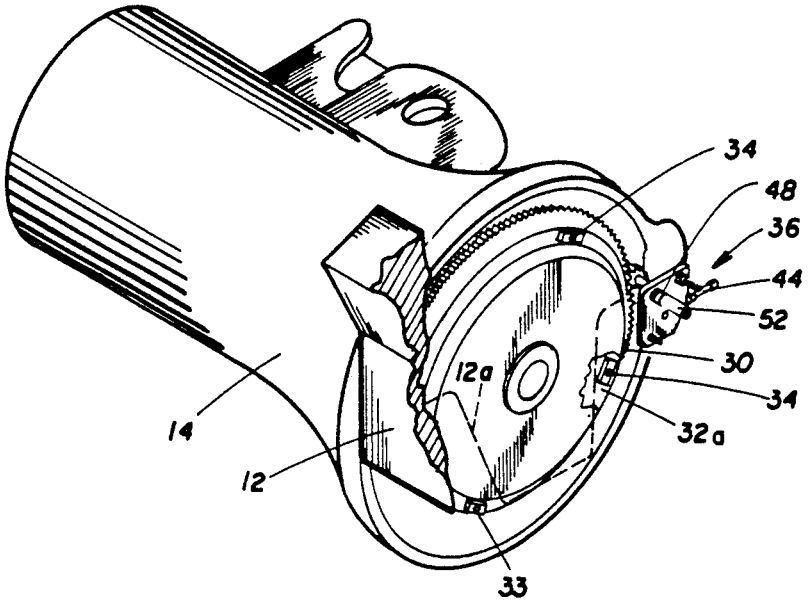
FIG. 2 is a view in perspective, partially broken away of a torque converter with the tool of this invention installed.
Figure 3:
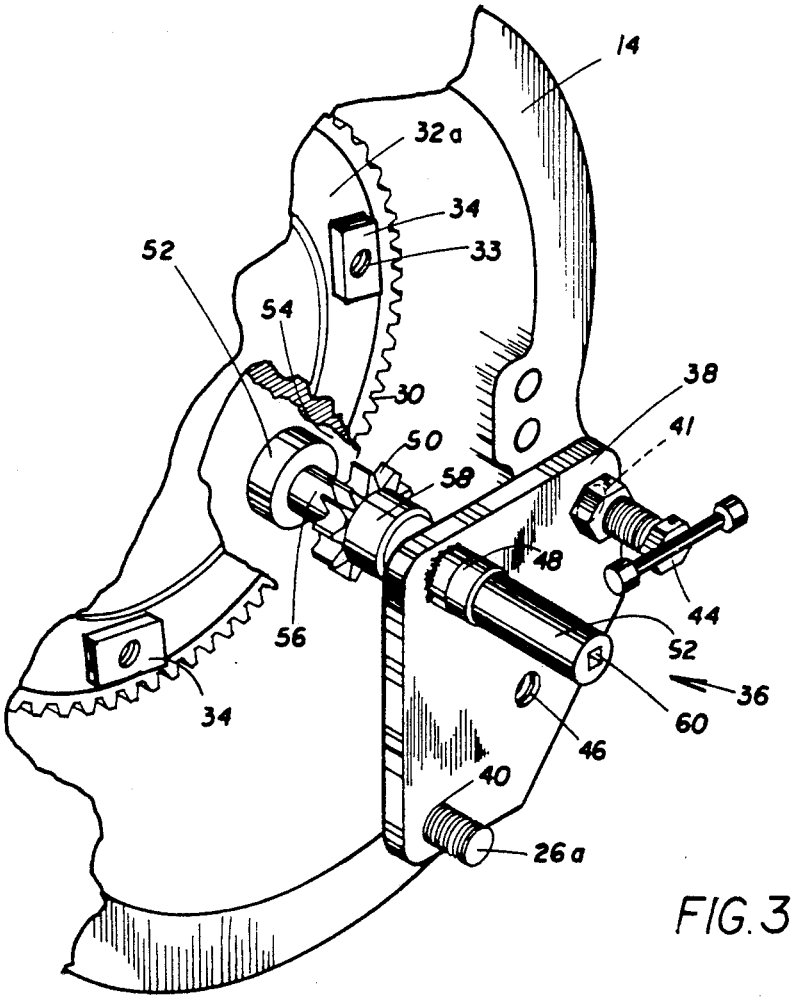
FIG. 3 is a enlarged partial section view of a portion of the torque converter with the tool in place.

Referring now more particularly to FIGS. 2 and 3 there is shown a "mechanic's eye view" from below of the torque converter bell housing 14, as viewed with the cover plate 28 removed. For clarity, the engine 12 is broken away but that portion of the torque converter bell housing 14 covered by the engine 12 is shown by dotted line 12*a*. The first step after gaining access to the interior of the torque converter bell housing 14 is to remove, one at a time, the cap screws (not shown) which are received in tapped holes 33 in bosses 34, which are spaced around the drive plate 32*a* to couple drive plate to the engine crank shaft. Therefore, as previously described, the bosses 34 have to be exposed individually or in pairs by jogging the ring gear 30 around through increments of rotation.

The tool 36 of this invention includes a mounting plate 38 that slides over the positioning stud 26*a*, which is normally used to locate the starting motor 26. A second bored hole 41 is positioned to expose a tapped hole in the torque converter bell housing that normally receives a cap screw or the like to hold the starter in place. For the purpose of securing the mounting plate 38 in place, a thumb screw 44 is provided. When the tool 36 is not in use, the thumb screw 44 may be retained by threading it into a tapped hole 46 in mounting plate 35.

Rotatably mounted in the mounting plate 38 is a shaft 48 that carries a pinion 50 near the inboard end thereof. Preferably mounted on the inboard end is a rotary bearing 52 that is adapted to be received in the bearing support recess 54 which is customarily provided in the torque converter housing 14 to receive the nose piece and shaft of the starter motor 26. Suitable spacers 56 and 58 are provided to locate the pinion 50 accurately on the shaft 48, and the outboard end of the shaft is formed, as with a square socket 60 to enable the mechanic to turn the shaft 48 with a suitable socket wrench (not shown). Means may be provided for attachment of an extended universal or drive cable or the like for more remote operation.

In operation, the tool 36 may be installed to enable rotation of the ring gear 30 in either direction under close and precise control. Then, the cap screws may be loosened and removed, one or two at a time from the bosses 34 on the drive plate 32*a* to separate the torque converter 14 from the engine 12. As each cap screw is being loosened, the mechanic may use one hand to hold the shaft 48 and hold the ring gear 30 and prevent it from turning away from its intended position.

When necessary repairs are effected, the procedure is reversed in precise, closely controlled increments, so that, when the drive plate 32*a* is back in place, the cover plate 28 (FIG. 1) and then the starter motor 26 may be replaced.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A tool to facilitate removal and servicing an automotive automatic transmission, which includes a housing operatively mounted on a engine, a wheel rotatably mounted in said housing for driving engagement with said engine and a ring gear on said wheel, said ring gear in normal use being engaged by the pinion of a starter motor positioned on said housing by a locator stud thereon and secured thereto by a cap screw threadedly engaging a tapped hole therein, said wheel being only partially exposed for servicing but said starter motor being accessible for removal when said transmission is in operative position on said engine;

said tool comprising:

a plate;

a first hole through said plate receivable over the starter motor locator stud when said starter motor is removed;

a second hole through said plate for slideably receiving a screw to be threadedly engaged in said tapped hole;

a shaft rotatably mounted in said plate and extending therethrough on both sides thereof;

a pinion on said shaft on the inboard portion thereof positioned to mesh with said ring gear; and means on the outboard portion of the shaft enabling said shaft to be gripped for manual rotation thereof.

2. The tool defined by claim 1 wherein said last-named means comprises:

a square socket in said outboard portion adapting it to be engaged by a socket wrench.

3. The tool defined by claim 1 including:

rotary bearing means on the inboard end of said shaft engagable in a bearing and alignment support recess in said transmission housing.

4. The tool defined by claim 1 including:

a third hole in said plate internally threaded in conformity with said tapped hole in said housing; and a hand operated screw threadedly receivable in said third hole.

5. A tool to facilitate servicing an automotive automatic transmission, which includes a housing operatively mounted on a engine, a wheel rotatably mounted in said housing for driving engagement with said engine and a ring gear on said wheel, said ring gear in normal use being engaged by the pinion of a starter motor secured to said housing by screw means, said wheel being only partially exposed for servicing but said starter motor being accessible for removal when said transmission is in operative position on said engine;

said tool comprising:

a plate adapted to be attached to said housing when said starter motor is removed;

a shaft rotatably mounted in said plate and extending therethrough on both sides thereof;

a pinion on said shaft on the inboard portion thereof positioned to mesh with said ring gear; and means on the outboard portion of the shaft enabling said shaft to be gripped for manual rotation thereof.

6. The tool defined by claim 5 wherein said last-named means comprises:

means on said outboard portion adapting it to be operatively engaged by a wrench.

7. The tool defined by claim 6 including:

rotary bearing means carried on the inboard end of said shaft engagable in a bearing alignment support recess in said transmission housing.

* * * * *